US009957130B2

(12) United States Patent
Irle

(10) Patent No.: US 9,957,130 B2
(45) Date of Patent: May 1, 2018

(54) METHOD OF FOLDING PAPER

(71) Applicant: ROTH + WEBER GMBH, Niederdreisbach (DE)

(72) Inventor: Alexander Irle, Freudenberg (DE)

(73) Assignee: ROTH + WEBER GMBH, Niederdreisbach (DE)

( * ) Notice: Subject to any disclaimer, the term of this patent is extended or adjusted under 35 U.S.C. 154(b) by 482 days.

(21) Appl. No.: 14/415,505

(22) PCT Filed: Aug. 1, 2013

(86) PCT No.: PCT/EP2013/066167
§ 371 (c)(1),
(2) Date: Jan. 27, 2015

(87) PCT Pub. No.: WO2014/020103
PCT Pub. Date: Feb. 6, 2014

(65) Prior Publication Data

US 2015/0175384 A1 Jun. 25, 2015

(30) Foreign Application Priority Data

Aug. 3, 2012 (DE) ..... 10 2012 015 466

(51) Int. Cl.
*B65H 67/08* (2006.01)
*B65H 45/16* (2006.01)
*B65H 45/20* (2006.01)

(52) U.S. Cl.
CPC ..... *B65H 67/08* (2013.01); *B65H 45/16* (2013.01); *B65H 45/20* (2013.01)

(58) Field of Classification Search
CPC ..... B65H 45/20; B65H 67/08; B65H 45/16
(Continued)

(56) References Cited

U.S. PATENT DOCUMENTS 4,484,905 A * 11/1984 Ashburner ..... B65H 45/20 493/415
5,085,624 A * 2/1992 Felix ..... B65H 45/101 493/410

(Continued)

FOREIGN PATENT DOCUMENTS

DE 102009032159 B 1/2001
SU 1052462 A 11/1983
WO WO2011003508 A1 * 1/2011 ..... B65H 45/101

*Primary Examiner* — Thanh Truong
*Assistant Examiner* — Nicholas Igbokwe
(74) *Attorney, Agent, or Firm* — Andrew Wilford

(57) ABSTRACT

A method for folding paper by means of a folding machine having a folding station, wherein a portion of a paper web (9) supplied to same is firstly folded in a first stack (10) containing continuous sheets and, after reaching a threshold value of the thus-created first stack (10), moved into a stacker (15) and thus remains in contact, via a folded stacking area (12) with a further portion of the paper web (9), wherein a section of the folded stacking area (12) serves as basis for a further subsequent stack of continuous sheets to be folded thereupon. Such method is intended to be developed such that only the smallest possible loops are required. To this end, before moving the first stack (10) into the stacker (15) the folded stacking area (12) is withdrawn out of the folding station from the first already folded stack (10), the folded stacking area (12) is fed back into the folding station while the first stack (10) is moved into the stacker (15), and then the already folded stacking area (12) fed back into the folding station serves as the basis for the subsequent stack to be folded, and the process of withdrawing the folded stacking area (12) after reaching a threshold value of the subsequent stack is repeated until the whole paper web (9) supplied has finished being folded.

2 Claims, 2 Drawing Sheets

(58) Field of Classification Search
USPC ..... 493/430, 433, 451, 442, 434, 427
See application file for complete search history.

(56) References Cited

U.S. PATENT DOCUMENTS

| | | | | |
|---|---|---|---|---|
| 5,139,247 | A | 8/1992 | Meschi | |
| 5,616,113 | A * | 4/1997 | Van Den Bergh ... | B65H 45/109 270/39.05 |
| 6,511,408 | B2 * | 1/2003 | Miki ..... | B31F 1/0019 493/413 |
| 8,298,127 | B2 | 10/2012 | Terhaag | |
| 2011/0130262 | A1 * | 6/2011 | Terhaag ..... | B65H 45/20 493/409 |

* cited by examiner

METHOD OF FOLDING PAPER

CROSS REFERENCE TO RELATED APPLICATIONS

This application is the US-national stage of PCT application PCT/EP2013/066167 filed 1 Aug. 2013 and claiming the priority of German patent application 102012015466.6 itself filed 3 Aug. 2012.

FIELD OF THE INVENTION

The invention concerns a method of folding paper with a folding machine having a folding station, and a portion of a paper web supplied to it is first folded into a first stack containing continuous sheets and, and after reaching a threshold value of the first stack thus created, is moved into a tray and thus remains connected to the remaining part of the paper web via a folded trailing sheet, and a section of the folded trailing sheet serves as the basis for a further subsequent stack of continuous sheets to be folded thereupon.

BACKGROUND OF THE INVENTION

It is known that industry and document reproduction providers, for example, use large-format paper webs, in particular printed paper webs, to record technical documentation or other comprehensive data records thereupon. The standard widths of such paper webs range up to 914 millimeters (36"). The length of the paper web—and thus that of the document—can vary and can measure up to 100+ meters depending on application.

It is also known that large-format documents of this type are folded for easier handling or archiving. In Germany, standardized folding of technical documents is regulated in DIN 824. Folding standards vary by country.

Paper-folding of this type is usually as automated as possible, with folding machines being able to handle both lengthwise and widthwise folding and using rollers or belts, for example, for folding.

In this case, however, the length of the paper web to be folded one time, and thus the size of the documents being processed once are subject to technical limits. Because of this, the process of folding the printed paper web results in the formation of stacks of pages folded one-over-the-other that must be transported by components (for example rollers, folding belts) of the folding machine. These components must therefore be movable so that they provide the required space. The mobility of these components, however, compromises the accuracy of the folding. The folding length, i.e. the total width of the folded pages, is thus limited to approximately 6 m on roller-based folding machine when using 80 g/m$^2$ weight paper. With a belt-based folding machine, the folding length for such paper would be limited to approximately 12 m. In both cases, the costs would rise disproportionately as folding length increases.

To be able to achieve large folding lengths for paper webs of several tens of meters to over one hundred meters, however, semiautomatic methods are designed, for example, such that stacks are initially folded to the maximum possible paper length and then moved from the folding machine into a storage position. The paper web remains connected to a further portion of the paper web via an unfolded trailing sheet, and a section of this trailing sheet serves as the basis for an additional subsequent stack of continuous sheets to be folded thereupon. This subsequent stack can then also be built up to the technologically possible length and then discharged. This method can be continued over multiple stacks. This results in a product of at least a few automatically generated folding packages that are connected to one another via unfolded trailing sheets. These trailing sheets must then be manually refolded by a system operator so that the individual folding stacks can be set one on the other to form a large stack. This manual folding of the trailing sheets is time-consuming, labor-intense and involves a high rate of failure.

DE 10 2009 032 159 discloses a fully automatic folding machine and a folding method in which an unfolded portion must be outputted when a paper stack is deposited in a tray and then retracted into the folding machine with at least a portion of the folded layers following the depositing of the paper stack so that these areas can be used as the basis for a folding stack. This comparatively large retracted portion of the paper can subsequently cause folding inaccuracies and delays in the folding procedure.

WO 2010/018059 [U.S. Pat. No. 8,298,127] also discloses a fully automatic folding method in which the paper is held back in the folding station while the folded stack is moved into the tray. During this time, the paper supply to the folding station must be stopped. Because, however, the upstream device, for example a printer or plotter or similar continuously operates, this results in a large loop of paper that must be handled when the subsequent stack is created.

OBJECT OF THE INVENTION

The object of the invention seeks is to provide a method of folding paper such that the disadvantages described above are avoided and in which only the smallest possible loop is necessary.

SUMMARY OF THE INVENTION

To solve this problem it is proposed that before moving the first stack through the folding station outlet into the tray the trailing sheet is withdrawn from the folding station from the first already folded stack through the folding station intake, that the trailing sheet is fed back into the folding station while the first stack is moved into the tray, that the already folded sheet fed back into the folding station serves as the basis for the subsequent stack being folded, and that the process of withdrawing later trailing sheets upon reaching the particular threshold values is continued until the entire paper web supplied is completely folded.

Withdrawing the trailing sheet from the already folded stack in the folding machine and before it is discharged from the folding machine toward the tray results in the loop upstream of the folding machine being equal in size only to approximately the set folding length.

In a generic method in which the stack is guided alternatingly between three rollers into guide plates, it has proven advantageous that upon reaching the threshold value, the paper web is folded in the next folding step between two of the rollers only such that the rollers and the supply rollers are reversed after folding is performed, that after the completed fold has left the gap between the rollers, the rollers are once again reversed, while the supply rollers continue to pull the trailing sheet further out of the folding station, that at this point the first stack is guided into a guide plate and guided outward via same, that the supply rollers are then reversed when the next to last fold has left the gap between rollers and that after the first stack has exited the guide plate and reached the tray, the rollers are reversed for stacking again.

This way, after the paper web has been folded without the stack being transported further into the corresponding guide plate, the folding and supply rollers are reversed, and as soon as the fold has left the gap between the rollers folding it, the rollers can be reversed again. The supply rollers continue to further withdraw the paper web, but as soon as the second to last fold has exited the gap between the rollers that have created the second to last fold, the supply rollers can be reversed again. Thus the set length between folds has effectively been withdrawn only approximately one time by the supply rollers. The loop that has formed from the withdrawn paper web plus the further conveyed paper web is thus very small. The elimination of the loop can be started as early as when the stack is transported into the tray. In addition, only a comparatively small portion of the paper web is withdrawn for further processing, thereby allowing folding inaccuracies to be avoided.

BRIEF DESCRIPTION OF THE DRAWING

The invention is described below in greater detail using drawings.

SPECIFIC DESCRIPTION OF THE INVENTION

Figure 1:
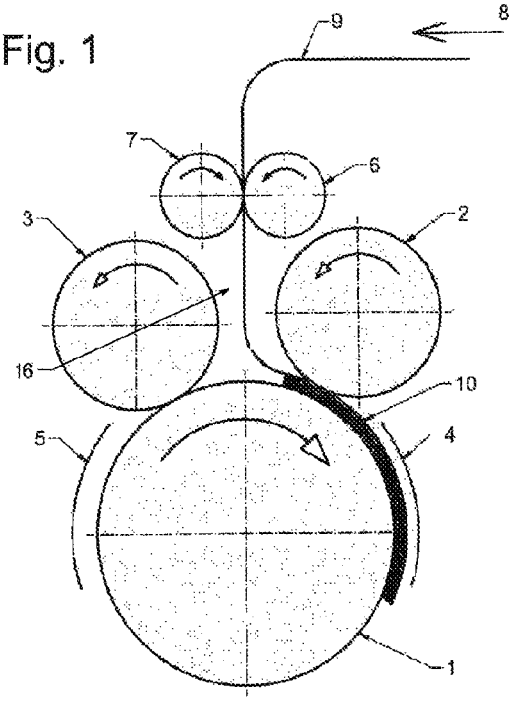
FIGS. 1 to 8 show a folding machine operated and controlled using the method according to the invention.

The drawing shows a folding station 16 formed between a roller 1 and rollers 2 and 3 cooperating with the roller 1. Guide plates 4 and 5 are associated with the roller 1. Supply rollers 6 and 7 feed a paper web 9 in a direction 8 to the rollers 1 to 3.

Figure 2:
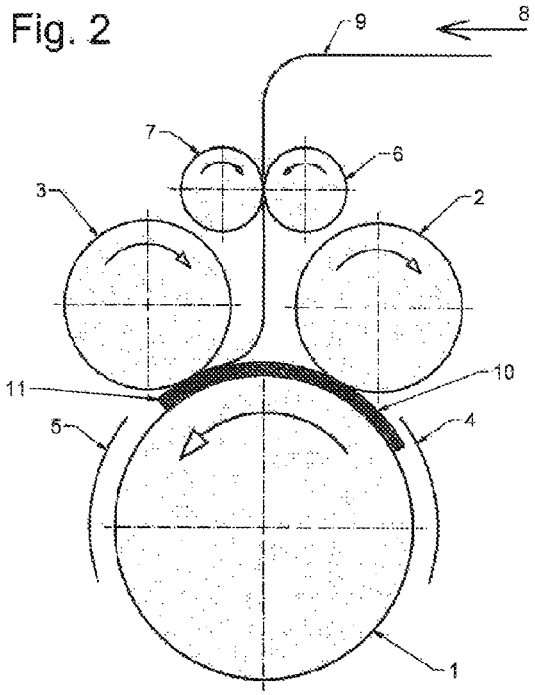
Figure 3:
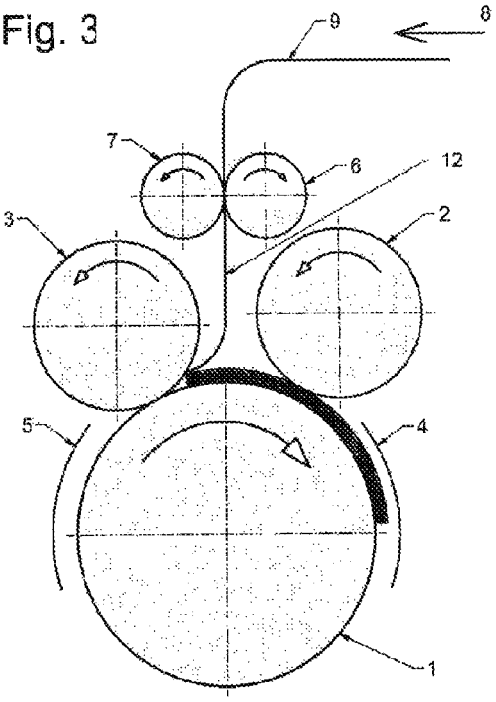

FIG. 1 shows a first folded stack 10 made from the paper web 9 positioned between the rollers 1 and 2 and juxtaposed with the guide plate 4. The rollers 1 to 3 are repeatedly reversed to form folds 11 between the rollers 1 and 3 as shown in FIG. 2. Immediately following formation of the folds 11, the rollers 1 to 3 and supply rollers 6 and 7 are reversed as shown in FIG. 3. Reversing the supply rollers 6 and 7 then causes a trailing sheet 12 of the paper web 9 to be pulled from the folding station 16.

Figure 4:
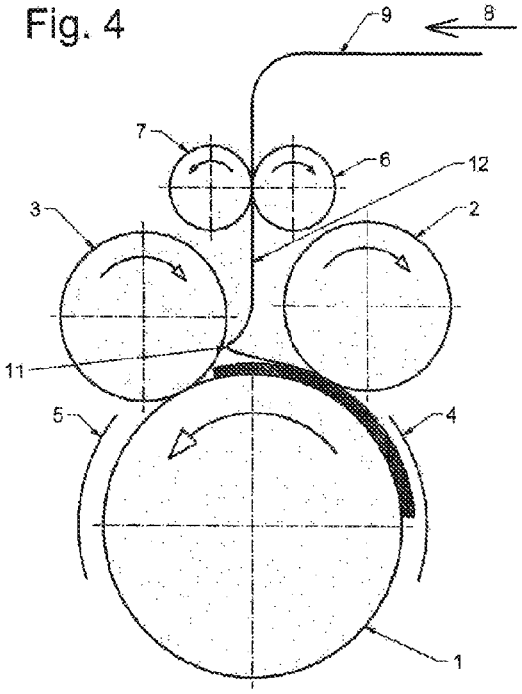

After the folds 11 have exited the gap between the rollers 1 and 3, the rollers 1 to 3 are reversed again, while the supply rollers 6 and 7 continue to pull the trailing sheet 12 of the paper web 9 farther out of the folding station 16 (see FIG. 4).

Figure 5:
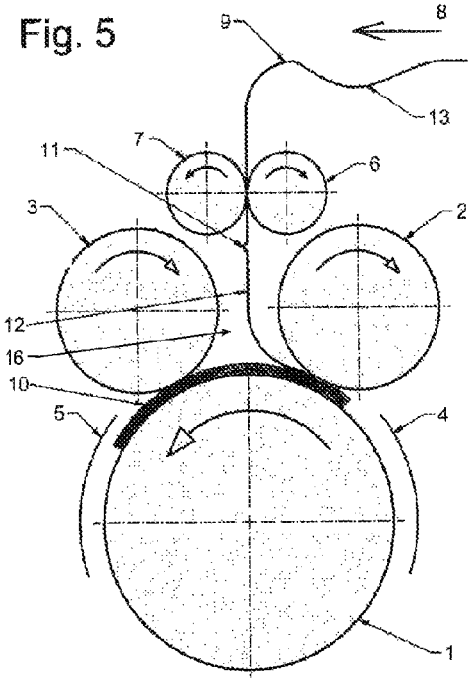
Figure 6:
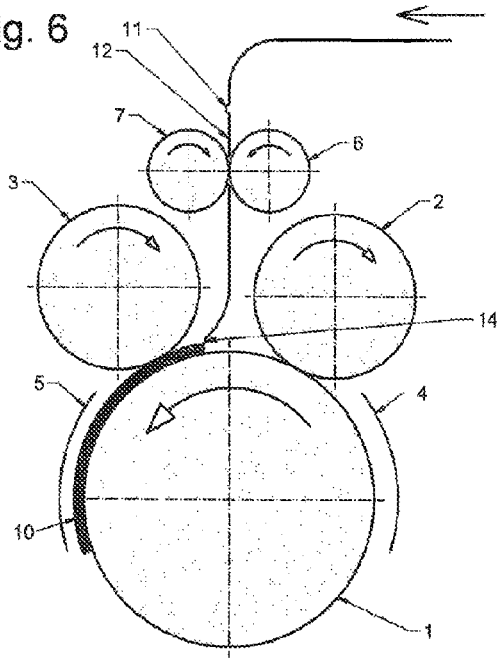

FIG. 5 shows a loop 13 resulting from the withdrawing of the trailing sheet 12 of the paper web 9 from the folding station 16 and the continued feeding of the paper web 9 to the folding station 16. As FIG. 5 illustrates, the first stack 10 is fed back by the rollers 1 and 3 and toward the guide plate 5. After the second to last fold 14 has exited the gap between rollers 1 and 2, the supply rollers 6 and 7 are reversed (see FIG. 6). The trailing sheet 12 is then fed back into the folding station 16. The loop 13 is eliminated again.

Figure 7:
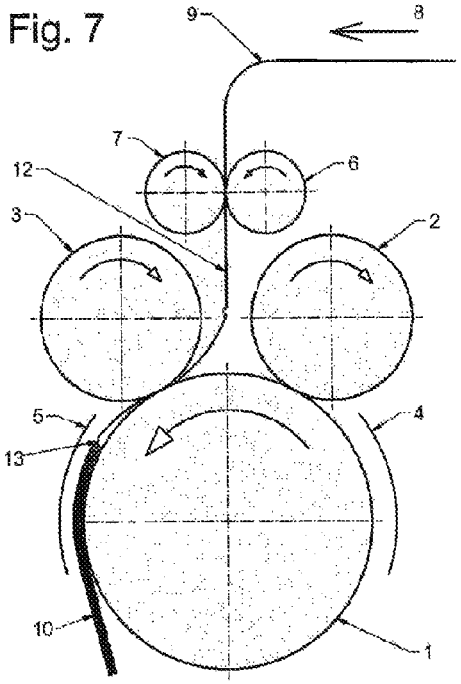
Figure 8:
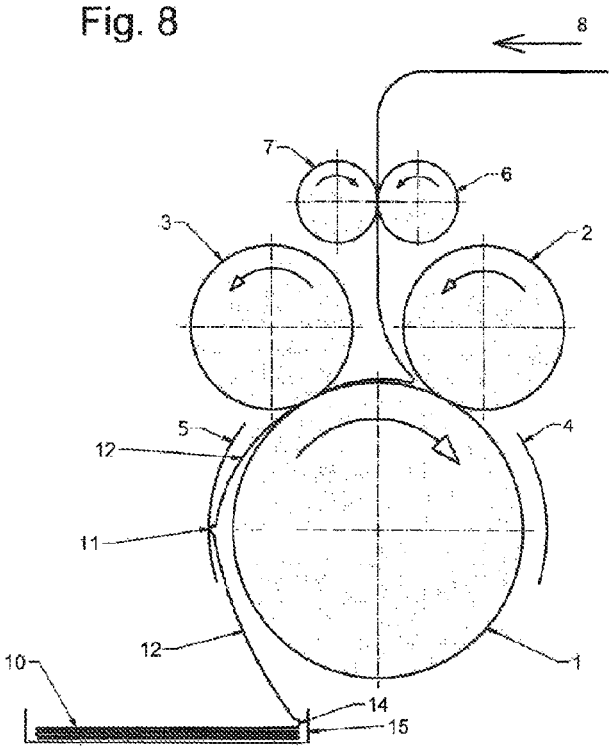

As FIG. 7 illustrates how the first stack 10 is conveyed outward toward the tray 15 (FIG. 8) via the guide plate 5. After the first stack 10 has reached the tray 15 and the folds 11 are advanced into the guide plate 5 according to the planned length of the paper web to be folded, the rollers 1 to 3 are reversed again. Folding of the subsequent stack is thereby resumed between rollers 1 and 2 as in FIGS. 1-7.

The invention claimed is:

1. A method of folding an elongated paper web with a folding machine having a folding station, the method comprising the steps of sequentially:

a) initially supplying a leading portion of the web to the machine and folding the leading portion into a first stack of continuous sheets connected to a following portion of the paper web via a folded trailing sheet of the first stack;

b) withdrawing the folded trailing sheet in the folding station from the folded stack;

c) moving the first stack into a tray while holding back the folded trailing sheet such that the folded trailing sheet does not move into the tray;

d) folding a leading portion of the following portion of the web into a subsequent stack with the folded trailing sheet of the first stack constituting a leading sheet of the subsequent stack and a trailing sheet of the subsequent sheet connecting the subsequent stack to a following portion of the paper web; and e) after each execution of step d) repeating steps b) through d) until the whole paper web supplied is completely folded.

2. The method according to claim 1, wherein the stack is fed alternatingly between three folding rollers of the folding station into the guide plates, wherein after reaching a threshold value, the paper web is folded between the folding rollers in the next folding step, the folding rollers and the supply rollers upstream therefrom are reversed after folding is completed after the folds have left the gap between the folding rollers, the folding rollers are reversed again, while the supply rollers continue pulling the folded trailing sheet further out of the folding station, at this point the first stack is guided into a guide plate and outward via same, the supply rollers are then reversed when the next to last fold has exited the gap between the folding rollers, and after the stack has left the guide plate and reached the tray, the folding rollers are reversed for stacking again.

* * * * *